US005938028A

United States Patent [19]

Hu

[11] Patent Number: 5,938,028

[45] Date of Patent: Aug. 17, 1999

[54] TOOL HOLDER FOR HEXAGONAL WRENCHES

[76] Inventor: Bobby Hu, P.O. Box 63-247, No. 6, Alley 235, Lane 75, Section 3, Kang Ning Road, Nei Hu District, Taipei Taichung, Taiwan

[21] Appl. No.: 09/165,557

[22] Filed: Oct. 2, 1998

[51] Int. Cl.[6] ..... B65D 85/20

[52] U.S. Cl. ..... 206/377; 211/69; 211/70.6

[58] Field of Search ..... 206/376–378, 206/372; 211/69, 70.6; D3/274, 905; D8/71; D6/469

[56] References Cited

U.S. PATENT DOCUMENTS

| | | | |
|---|---|---|---|
| D. 163,263 | 5/1951 | Dodd et al. | D6/469 |
| 1,973,188 | 9/1934 | Verderber | 211/70.6 |
| 2,590,307 | 3/1952 | Gibson | 206/377 |
| 2,776,744 | 1/1957 | Cook | 206/377 |
| 4,767,006 | 8/1988 | Wasem | 206/377 |
| 5,394,984 | 3/1995 | Aiba | 206/377 |

*Primary Examiner*—Bryon P. Gehman

[57] ABSTRACT

A tool holder includes a main body having a bottom wall and a number of substantially L-shaped separation walls formed on the bottom wall, thereby defining a substantially L-shaped receiving compartment between each two adjacent separation walls. Each separation wall includes a first section and a second section. A resilient retaining member is mounted on the first section of each separation wall. Each receiving compartment includes a relatively longer section and a relatively shorter section. A guiding wall is extended across two second sections respectively of two adjacent separation walls. The guiding wall includes a downwardly extending guiding surface that faces the bottom wall. The downwardly extending guiding surface is preferably arcuate and inclines downwardly toward the bottom wall. The bottom wall includes a guiding surface section that is located below the downwardly extending guiding surface of the guiding wall and inclines downwardly along a direction parallel to the extending direction of the downwardly extending guiding surface of the guiding wall. The main body further includes a retaining wall provided to the relatively shorter section of each receiving compartment. The lower retaining wall includes an inner holding surface that faces the bottom wall. The bottom wall includes a holding surface section located above the guiding surface section. The downwardly extending guiding surface of the guiding wall and the guiding surface section of the bottom wall together guide a hexagonal wrench to be received in an associated receiving compartment. The inner holding surface of the retaining wall, the holding surface section of the bottom wall, and the retaining member together hold the hexagonal wrench in place.

4 Claims, 8 Drawing Sheets

TOOL HOLDER FOR HEXAGONAL WRENCHES

BACKGROUND OF THE INVENTION

1. Field of the Invention

The present invention relates to a tool holder, and more particularly to a tool holder for hexagonal wrenches (i.e., Allen wrenches).

2. Description of the Related Art

Allen wrenches are widely used in daily life, and tool holders therefor are used. A typical Allen wrench holder, as shown in FIGS. 1 and 2 of Taiwan Utility Model Publication No. 311514, generally comprises a number of receiving holes each having a flange formed on an inner periphery thereof for holding a relatively longer section of an Allen wrench. However, the flange is apt to be worn out after a term of usage and thus loses its holding function. In addition, removal of an Allen wrench held in the, e.g., fifth receiving hole requires previous 90° rotation of four Allen wrenches held in the preceding four receiving holes. Furthermore, the holder is usually made of plastic and thus might shrink during manufacture, which may affect the dimension of the flange. As a result, the Allen wrench may not be reliably held in place, as itself has a certain tolerance. FIGS. 3 and 4 of Taiwan Utility Model Publication No. 311514 illustrate another conventional Allen wrench holder which comprises a number of receiving holes each for holding the relatively longer section of an Allen wrench. Although retaining ribs are provided, the retaining effect is poor such that the Allen wrench is apt to disengage from the retaining ribs and thus declines. As a result, the Allen wrench may completely disengage from the holder. In order to solve this problem, Taiwan Utility Model Publication No. 311514 discloses an Allen wrench holder that includes two retaining points for each Allen wrench to be held, one for retaining the relatively longer section of the Allen wrench, while the other for retaining the relatively shorter section of the Allen wrench. Yet, the Allen wrench will sway if it only engages with one of the retaining points. In addition, the user must align the Allen wrench with the retaining points and then apply a force to insert the Allen wrench into the receiving compartment so as to hold the Allen wrench by the two retaining points. However, such operation requires both hands. Taiwan Utility Model Publication No. 295896 discloses an Allen wrench holder that has receiving compartments defined in both sides thereof for receiving Allen wrenches. Namely, it is merely a duplicate of the structure of Taiwan Utility Model Publication No. 311514 and thus has the same disadvantage.

The present invention is intended to provide an improved Allen wrench holder to solve the above-mentioned problems.

SUMMARY OF THE INVENTION

It is a primary object of the present invention to provide an improved tool holder for hexagonal wrenches in which a hexagonal wrench can be easily, quickly inserted into and thus retained in one of the receiving compartments of the tool holder.

It is another object of the present invention to provide an improved tool holder for hexagonal wrenches in which the tool holder includes durable resilient retaining members for reliably holding the hexagonal wrench.

A tool holder in accordance with the present invention comprises a main body including a bottom wall and a plurality of substantially L-shaped separation walls formed on the bottom wall, thereby defining a substantially L-shaped receiving compartment between each two adjacent separation walls. Each separation wall includes a first section and a second section. A resilient retaining member is mounted on the first section of each separation wall. Each receiving compartment includes a relatively longer section and a relatively shorter section.

A guiding wall is extended across two second sections respectively of two adjacent separation walls. The guiding wall includes a downwardly extending guiding surface that faces the bottom wall. The downwardly extending guiding surface is preferably arcuate and inclines downwardly toward the bottom wall. The bottom wall includes a guiding surface section that is located below the downwardly extending guiding surface of the guiding wall and inclines downwardly along a direction parallel to the extending direction of the downwardly extending guiding surface of the guiding wall.

The main body further includes a retaining wall provided to the relatively shorter section of each receiving compartment. The lower retaining wall includes an inner holding surface that faces the bottom wall. The bottom wall includes a holding surface section located above the guiding surface section.

The downwardly extending guiding surface of the guiding wall and the guiding surface section of the bottom wall together guide a hexagonal wrench to be received in an associated receiving compartment. The inner holding surface of the retaining wall, the holding surface section of the bottom wall, and the retaining member together hold the hexagonal wrench in place.

The resilient retaining member includes a protrusion on an end thereof that is distal to the bottom wall of the main body. The other end of the resilient retaining member and an associated separation wall includes a recess defined therebetween to allow deformation of the resilient retaining member.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
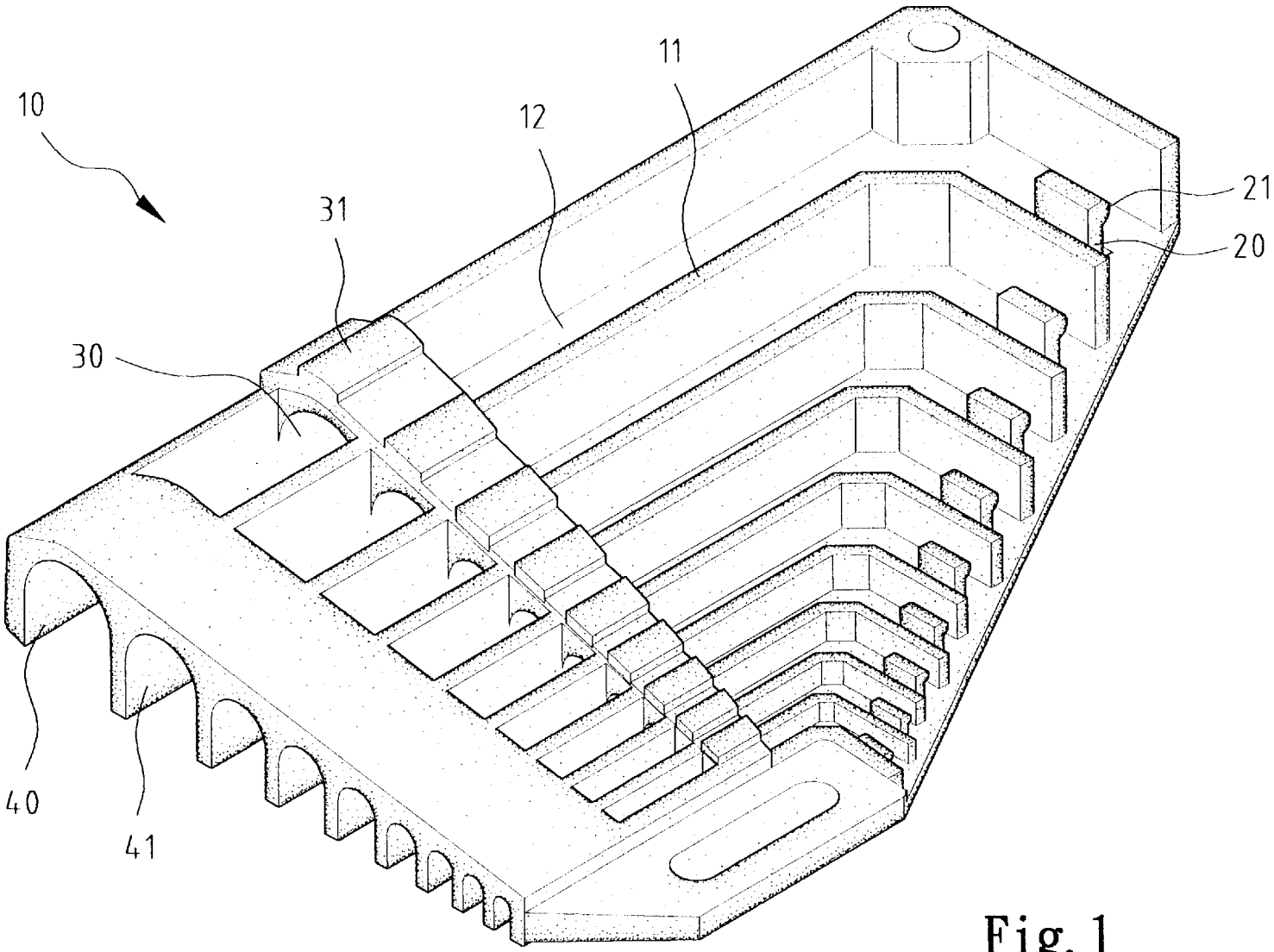
FIG. 1 is a perspective view of a tool holder in accordance with the present invention.
Figure 2:
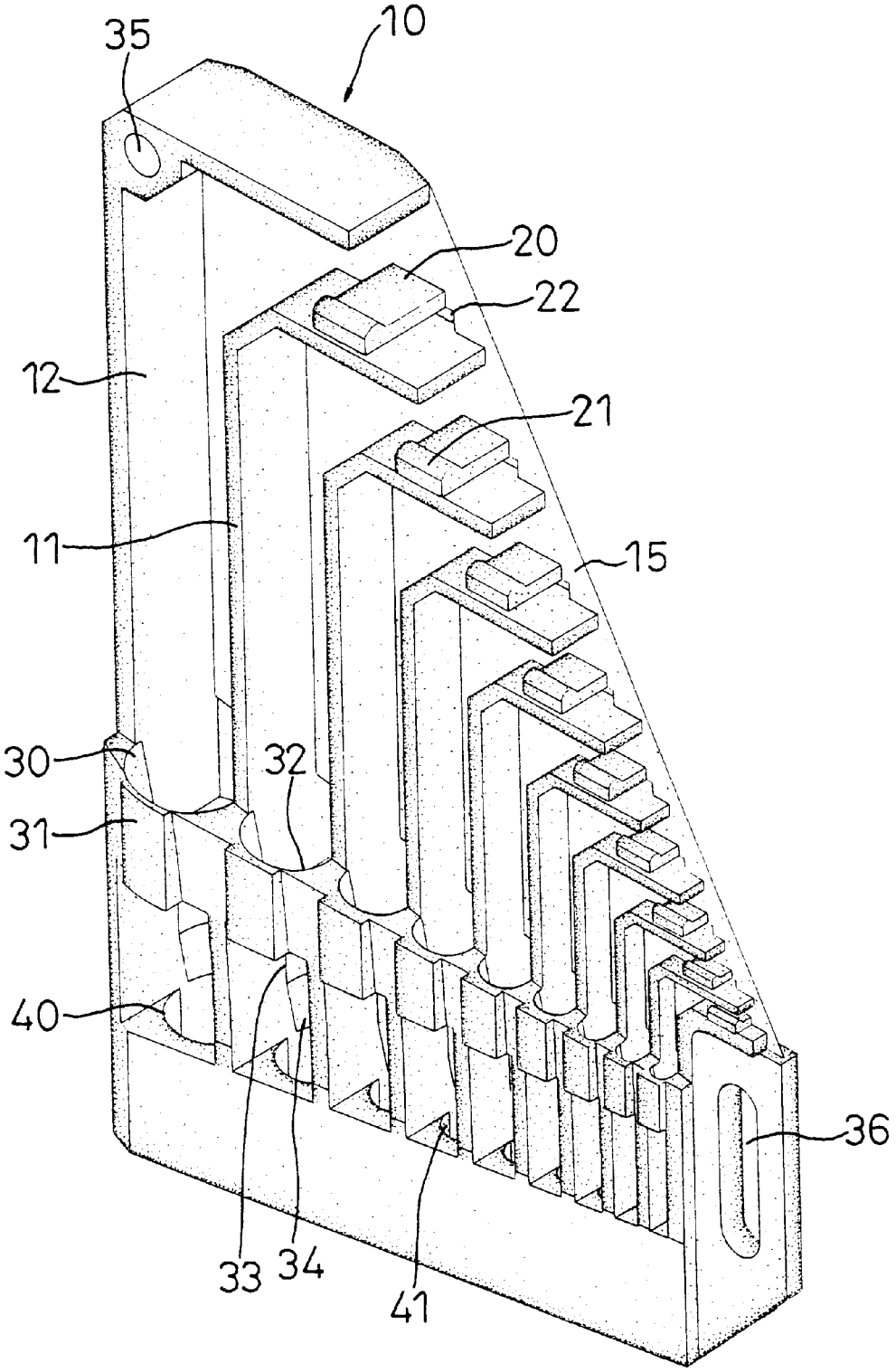
FIG. 2 is a perspective view of the tool holder viewed from another direction.

Referring to the drawings and initially to FIGS. 1 and 2, a tool holder in accordance with the present invention generally includes a main body 10 having a plurality of substantially L-shaped separation walls II formed on a bottom wall 15 of the main body 10. Thus, a receiving compartment 12 defined between each two adjacent separation walls 11 for receiving a certain size of Allen (hexagonal) wrenches. The receiving compartments 12 may be arranged to receive all sizes of Allen (hexagonal) wrenches. Each receiving compartment 12 is substantially L-shaped and includes a relatively longer portion (not labeled) for holding a relatively longer section of an Allen wrench and a relatively shorter portion (not labeled) for holding a relatively shorter section of the Allen wrench.

As shown in FIG. 2, each separation wall 11 includes a resilient retaining member 20 provided on a relatively shorter section thereof, the retaining member 20 having a protrusion 21 formed on an end thereof that is distal to the bottom wall 15 of the main body 10. A recess 22 is defined between the other end of the retaining member 20 and the associated separation wall 11. The recess 22 provides a space that allows deformation of the resilient member 20 when the relatively shorter section of an Allen wrench is held in the associated receiving compartment 20. Thus, the resilient retaining member 20 may keep its resiliency even after a long term of usage.

Figure 5:
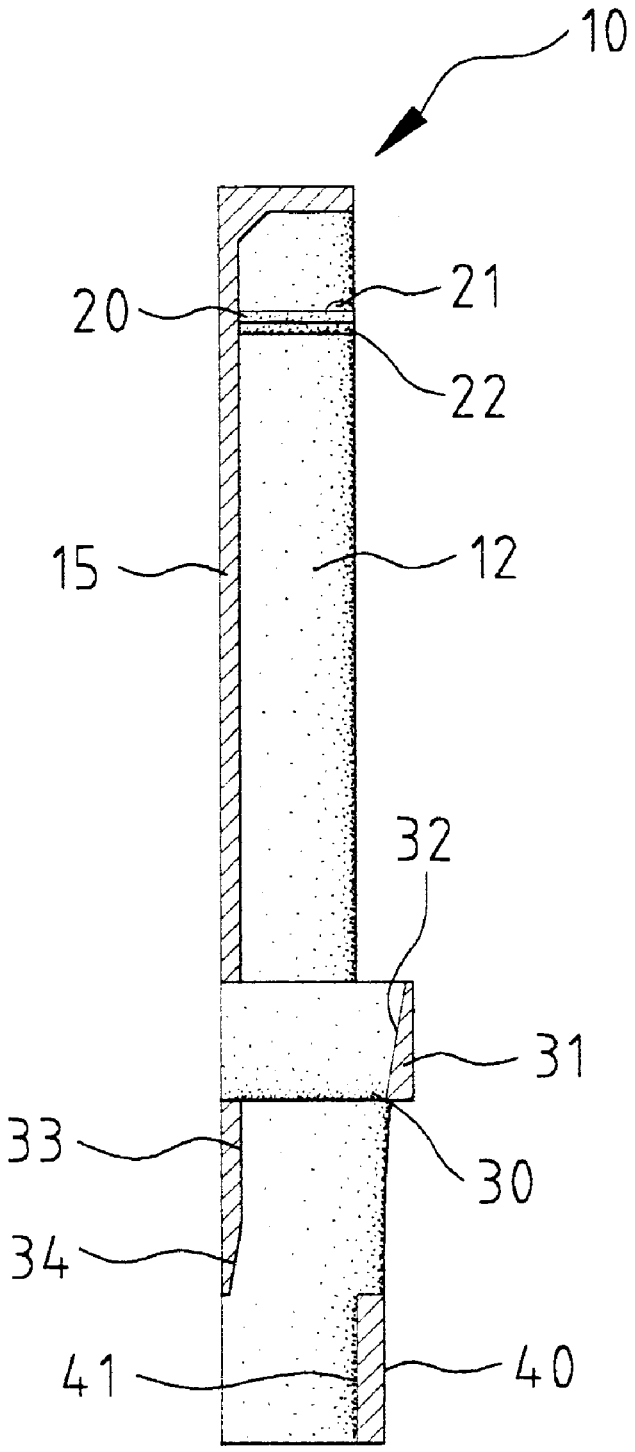
FIG. 5 is a sectional view illustrating a receiving structure of the tool holder in accordance with the present invention.

Referring to FIGS. 2 and 5, a guiding wall 31 is provided across the relatively longer sections respectively of two adjacent separation walls 11. The guiding wall 31 includes an arcuate guiding surface 32 that faces the bottom wall 15. The arcuate guiding surface 32 inclines downwardly toward the bottom wall 15. In addition, the bottom wall 15 includes a guiding surface section 34 that is located at a level below the arcuate guiding surface 32 and inclines downwardly along a direction parallel to the extending direction of the arcuate guiding surface 32, best shown in FIG. 5. The guiding wall 31 may be reinforced in structure by, e.g., a protruded portion thereon (not labeled), as shown in FIG. 2. Dimension of the receiving compartment 12 can be marked on an outer surface of the guiding wall 31 to indicate what size of Allen wrench can be received. A retaining wall 40 is provided to a lower end portion of each compartment 12. As shown in FIG. 5, the retaining wall 40 includes an inner holding surface 41 that faces the bottom wall 15. The bottom wall 15 includes a holding surface section 33 located above the inclined guiding surface section 34.

Figure 3:
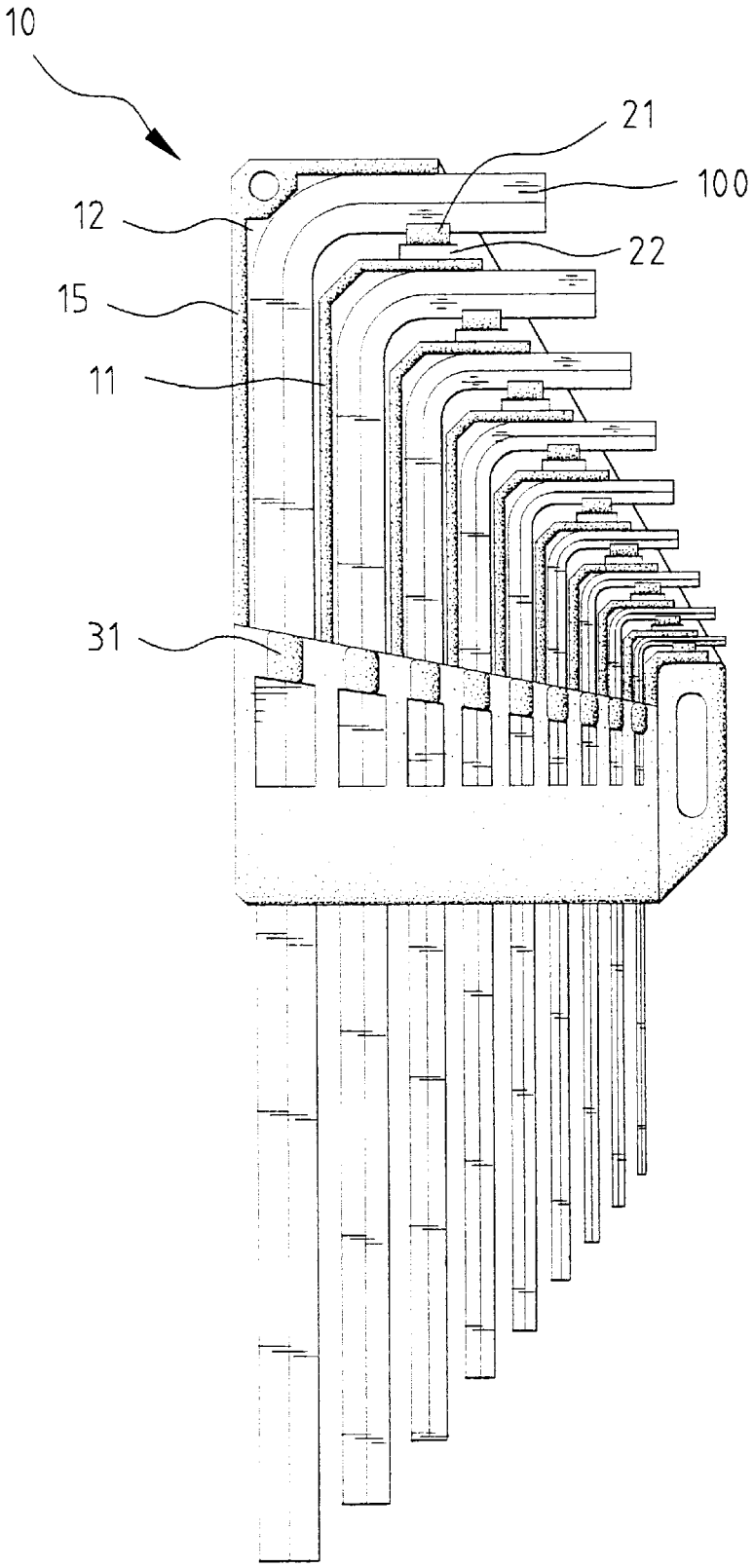
FIG. 3 is a front view of the tool holder with Allen wrenches held therein.
Figure 4:
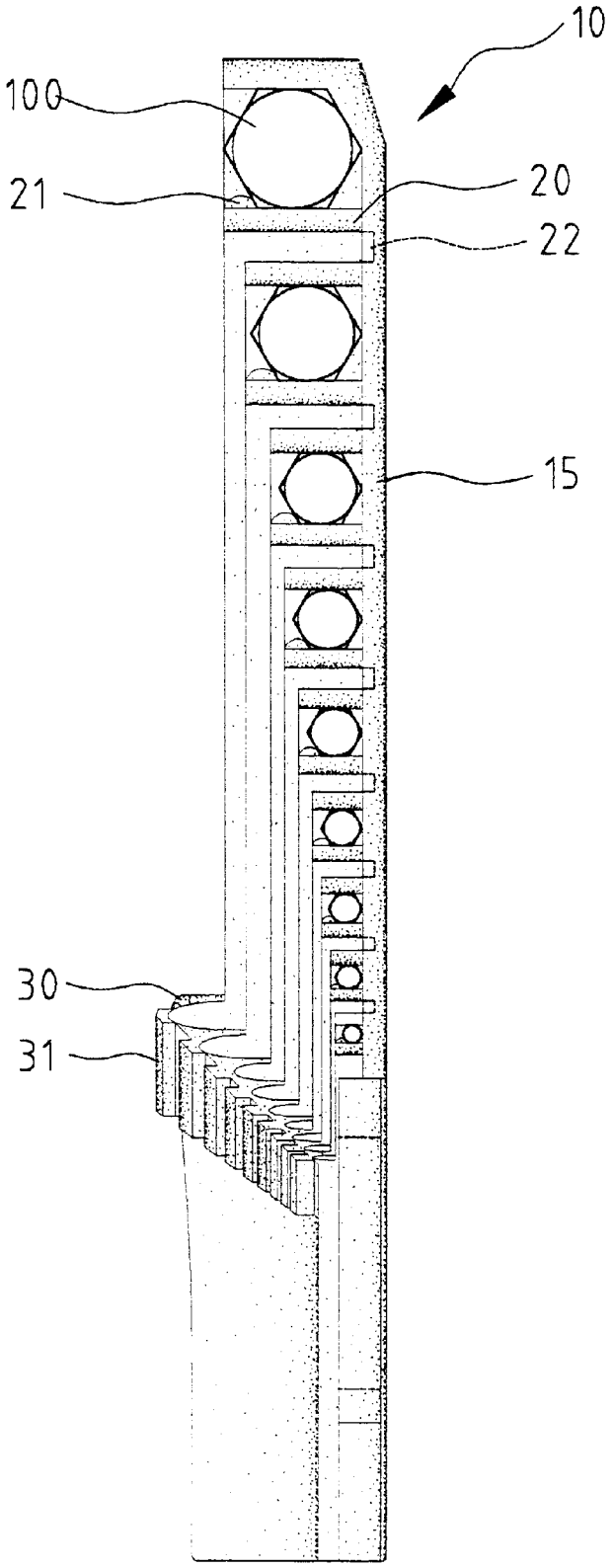
FIG. 4 is a side view of the tool holder in FIG. 3.
Figure 6:
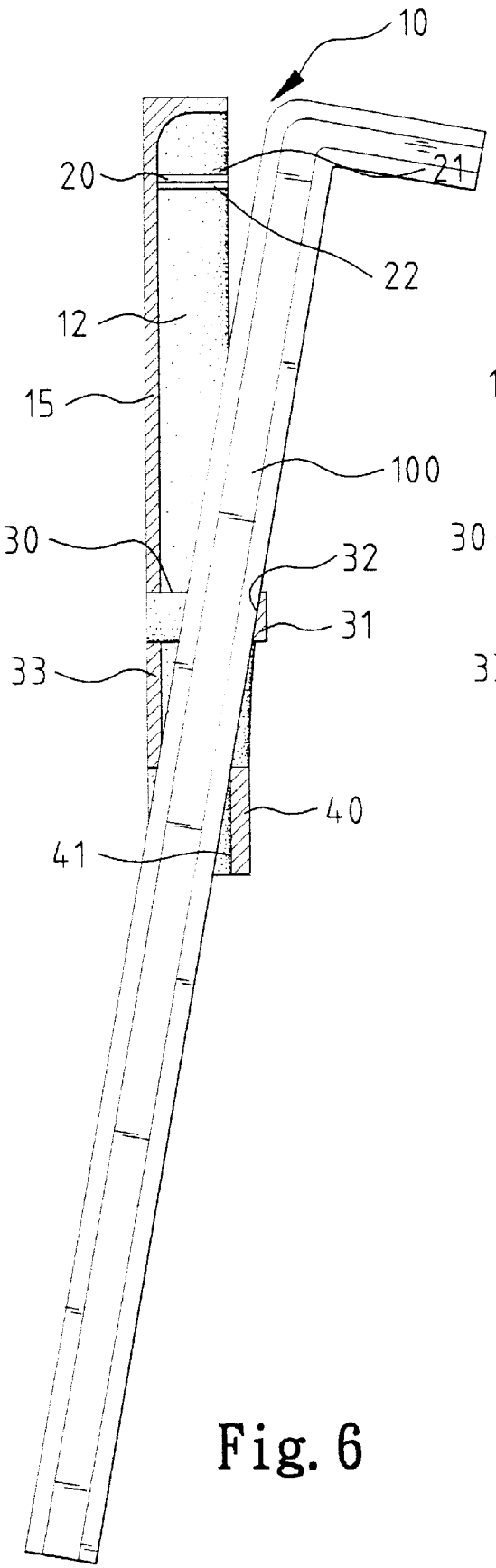
FIGS. 6 and 7 are schematic sectional views illustrating insertion of an Allen wrench into the tool holder in accordance with the present invention.
Figure 7:
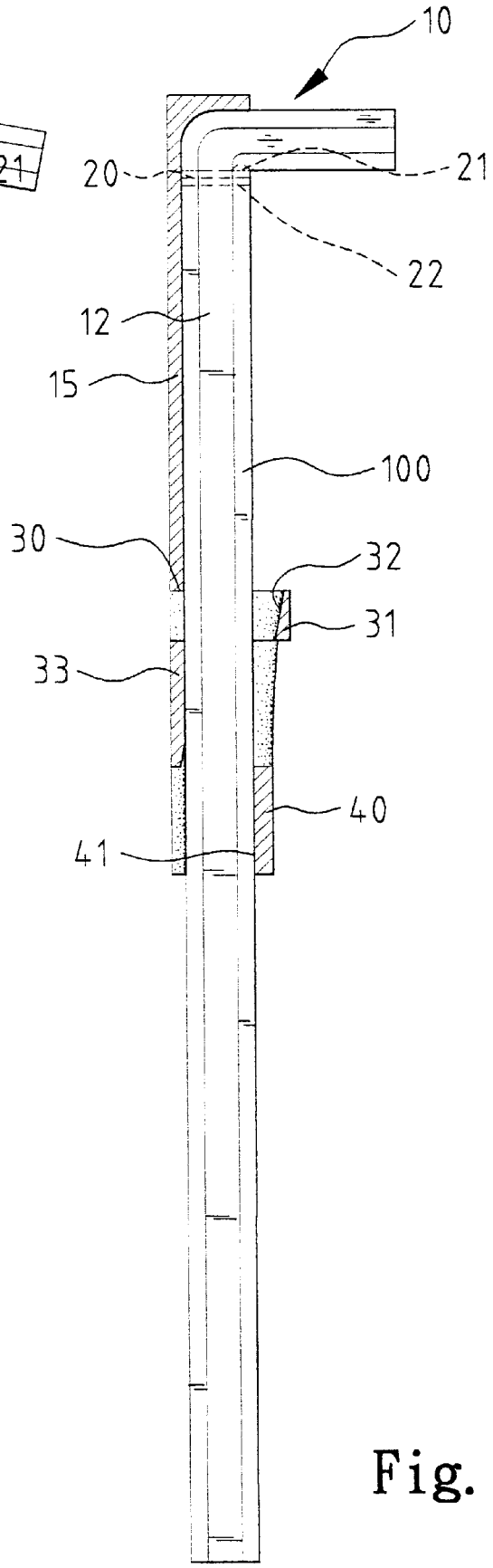
Figure 8:
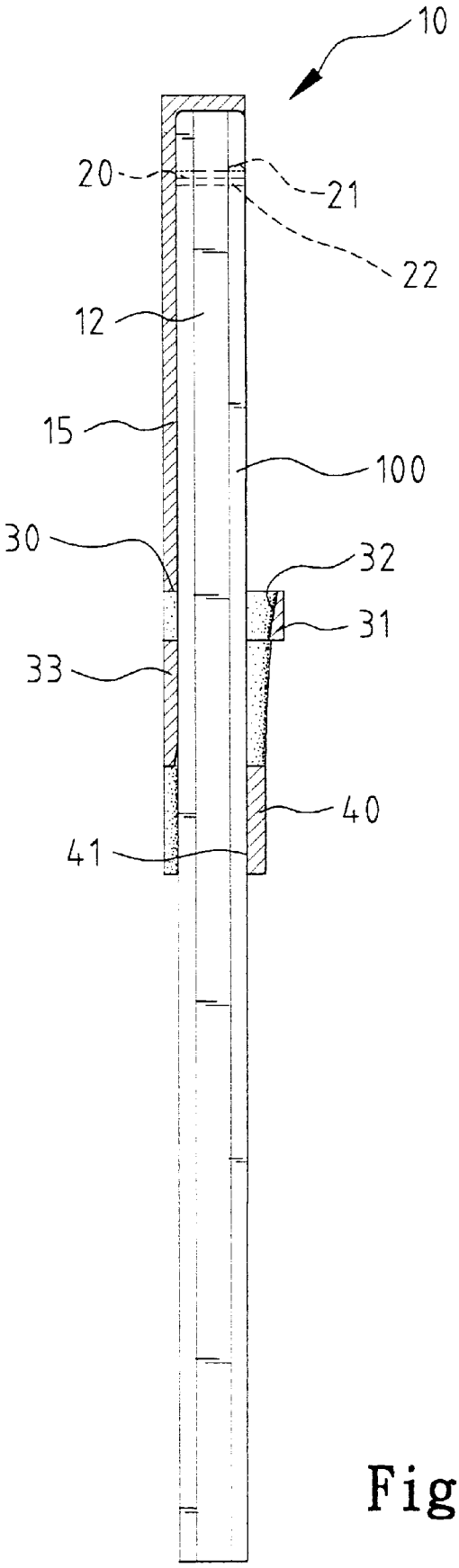
FIG. 8 is a sectional view illustrating holding of the Allen wrench.

FIGS. 3 and 4 illustrate an example of use of the Allen (hexagonal) wrench tool holder in accordance with the present invention. Referring to FIG. 6, in use, the user may insert the relatively longer section of an Allen wrench 100 into the relatively longer section of the associated receiving compartment 12 along the arcuate guiding surface 32 and the inclined guiding surface section 34 without any alignment with any portions of any elements. Next, the relatively shorter section of the Allen wrench 100 is moved to an upright position (FIG. 7), rotated through 90° (FIG. 8), and thus inserted into the relatively shorter section of the associated receiving compartment 12 by means of forcibly passing the relatively shorter section of the Allen wrench 100 through the protrusion 21 of the resilient retaining member 20. It is appreciated that insertion of the Allen wrench 100 is easy from a location above the guiding wall 31, and the Allen wrench 100 is smoothly guided downward along the arcuate guiding surface 32 and the guiding surface section 33 for subsequent insertion of the relatively shorter section of the Allen wrench 100 into the relatively shorter section of the receiving compartment 12. Thus, the Allen wrench 100 is securely held in place by the protrusion 21 of the retaining member 20, the inner holding surface 41, and the holding surface section 33, as shown in FIGS. 3 and 8. Removal of the Allen wrench 100 can be easily achieved by reversing the above procedures.

Figure 9:
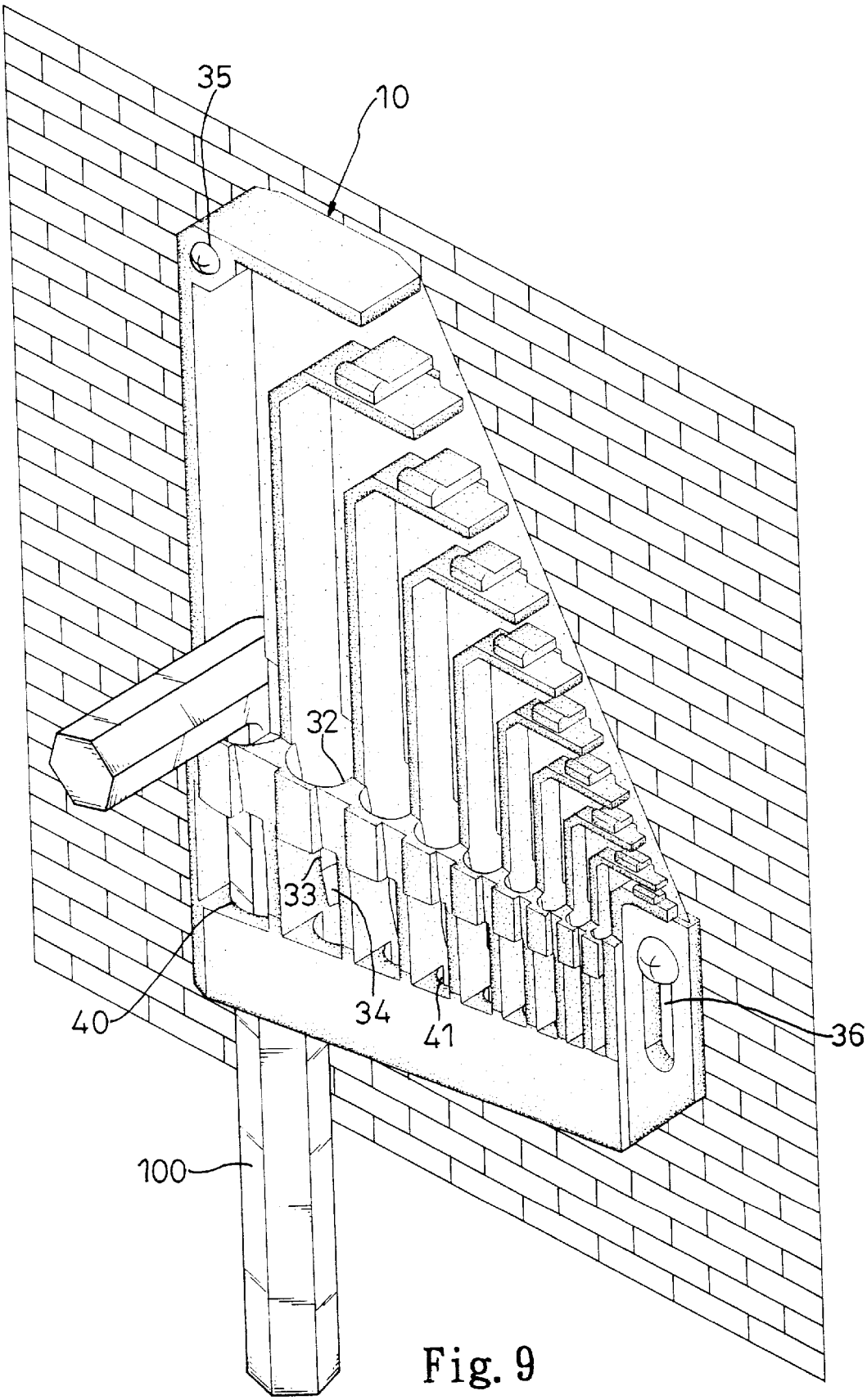
FIG. 9 is a perspective view illustrating a further use of the tool holder in accordance with the present invention.

The tool holder of the present invention can be fixed to a wall. As shown in FIG. 9, screws (not labeled) can be extended through holes 35 and 36 defined in the main body 10 of the tool holder to achieve the fixing function. Instead of received in the relatively shorter section of the receiving compartment 12, the relatively shorter section of the Allen wrench 100 may rest on the guiding wall 31, best shown in FIG. 9.

According to the above description, it is appreciated that the tool holder in accordance with the present invention has several advantages. Firstly, insertion of the Allen wrench can be done without any alignment procedure. Then, the relatively shorter section of the Allen wrench is rotated through 90° and then inserted into the relatively shorter section of the receiving compartment. All of these steps can be easily achieved by one hand. In addition, insertion and removal operations of the Allen wrench in the associated receiving compartment can be accomplished without interfering with the Allen wrenches in the other receiving compartments. Furthermore, the main body can be made by means of molding injection. And the retaining member 20 may reliably retain the Allen wrench in place.

Although the invention has been explained in relation to its preferred embodiment, it is to be understood that many other possible modifications and variations can be made without departing from the spirit and scope of the invention as hereinafter claimed.

What is claimed is:

1. A tool holder comprising:

a main body including a bottom wall and a plurality of substantially L-shaped separation walls formed on the bottom wall, thereby defining a substantially L-shaped receiving compartment between each two adjacent said separation walls, each said separation wall including a first section and a second section, a resilient retaining member being mounted on the first section of each said separation wall, each said receiving compartment including a relatively longer section and a relatively shorter section, a guiding wall being extended across two said second sections respectively of two adjacent said separation walls, the guiding wall including a downwardly extending guiding surface that faces the bottom wall, the downwardly extending guiding surface inclining downwardly toward the bottom wall, the bottom wall including a guiding surface section that is located below the downwardly extending guiding surface of the guiding wall and inclines downwardly along a direction parallel to the extending direction of the downwardly extending guiding surface of the guiding wall, and the main body further including a retaining wall provided to the relatively shorter section of each said receiving compartment, the retaining wall including an inner holding surface that faces the bottom wall, the bottom wall including a holding surface section located above the guiding surface section, whereby the downwardly extending guiding surface of the guiding wall and the guiding surface section of the bottom wall are adapted to together guide a hexagonal wrench to be received in an associated said receiving compartment, while the inner holding surface of the retaining wall, the holding surface section of the bottom wall, and the retaining member together hold the hexagonal wrench in place.

2. The tool holder as claimed in claim 1, wherein the resilient retaining member includes a protrusion on an end thereof that is distal to the bottom wall of the main body.

3. The tool holder as claimed in claim 2, wherein the other end of the resilient retaining member and an associated said separation wall includes a recess defined therebetween to allow deformation of the resilient retaining member.

4. The tool holder as claimed in claim 1, wherein the downwardly extending guiding surface is arcuate.

* * * * *